US007224110B2

(12) United States Patent
Geier et al.

(10) Patent No.: US 7,224,110 B2
(45) Date of Patent: May 29, 2007

(54) STARTING ELEMENT HAVING CERAMIC COMPONENT ELECTROSTATICALLY COATED WITH A DRY GLAZE

(75) Inventors: Heinz Geier, Leonberg (DE); Eckhardt Kuglin, Lich-Niederbessin (DE); Michael Hausser, Frankfurt (DE); Herbert Triptrap, Frankfurt (DE)

(73) Assignee: Robert Bosch GmbH, Stuttgart (DE)

( * ) Notice: Subject to any disclaimer, the term of this patent is extended or adjusted under 35 U.S.C. 154(b) by 89 days.

(21) Appl. No.: 10/470,526

(22) PCT Filed: Dec. 17, 2001

(86) PCT No.: PCT/DE01/04791

§ 371 (c)(1),
(2), (4) Date: Dec. 16, 2003

(87) PCT Pub. No.: WO02/061338

PCT Pub. Date: Aug. 8, 2002

(65) Prior Publication Data

US 2004/0095049 A1 May 20, 2004

(30) Foreign Application Priority Data

Jan. 29, 2001 (DE) ..... 101 04 121

(51) Int. Cl.
*H01T 13/20* (2006.01)

(52) U.S. Cl. ..... 313/143; 313/137; 445/7; 427/458; 427/472

(58) Field of Classification Search ..... 313/143, 313/145
See application file for complete search history.

(56) References Cited

U.S. PATENT DOCUMENTS 6,270,854 B1 8/2001 Schelling et al.

FOREIGN PATENT DOCUMENTS

| | | | |
|---|---|---|---|
| DE | 689 06 610 | | 11/1993 |
| DE | 199 30 334 | | 1/2001 |
| EP | 0 382 003 | | 8/1990 |
| EP | 1 065 446 | | 1/2001 |
| EP | 1139693 | | 10/2001 |
| GB | 2 332 021 | | 6/1999 |
| HU | 221886 | | 3/1998 |
| JP | 63 297925 | | 3/1989 |
| JP | 2243580 | | 9/1990 |
| JP | 4240132 | | 8/1992 |
| JP | 07 103480 | | 8/1995 |
| JP | 11 106234 | | 4/1999 |
| JP | 11106234 | A * | 4/1999 |
| JP | 2000516905 | T | 12/2000 |
| WO | WO 94/26679 | | 11/1994 |
| WO | WO 9426679 | A1 * | 11/1994 |
| WO | WO 97/08115 | | 3/1997 |
| WO | WO 98/54105 | | 12/1998 |
| WO | WO 98/58889 | | 12/1998 |

* cited by examiner

*Primary Examiner*—Mariceli Santiago
(74) *Attorney, Agent, or Firm*—Kenyon & Kenyon LLP

(57) ABSTRACT

A method for manufacturing a starting element, in particular a sheathed-element glow plug, for the combustion process in an internal combustion engine having a ceramic element (1, 3) is proposed, which substantially improves the glazing of the ceramic element (1, 3). According to the present invention, this is achieved by a dry glaze (2) being applied on the ceramic element (1, 3).

11 Claims, 2 Drawing Sheets

STARTING ELEMENT HAVING CERAMIC COMPONENT ELECTROSTATICALLY COATED WITH A DRY GLAZE

FIELD OF THE INVENTION

The present invention is directed to a method for manufacturing a starting element, in particular a sheathed-element glow plug.

BACKGROUND INFORMATION

Known starting elements for the combustion process in an internal combustion engine, such as a spark plug or a sheathed-element glow plug, include a ceramic element. Until now these ceramic elements were coated with a slip in a wet process, for example using a casting, dipping, spraying, sprinkling or roll-on method. Once the slip has been applied, the ceramic element is fired, the bakable material contained in the slip fusing or sintering to form a vitreous layer, often also referred to as ceramic layer.

However, a disadvantage of such wet chemical treatment methods is that the manufacture of the slip is comparatively expensive, that fouling processes may destroy the slip and that sedimentation processes must be counteracted, which results in waste-water problems and high energy consumption. Draining slip may form droplets and necessitate expensive aftertreatment. In heaters for a sheathed-element glow plug of a diesel engine the draining slip may result in a thin layer thickness, thereby increasing the danger of a short circuit.

SUMMARY OF THE INVENTION

The present invention is based on the objective of providing a method for manufacturing a starting element, in particular a sheathed-element glow plug, by which the above disadvantages are at least partially avoided.

Accordingly, a method according to the present invention for manufacturing a starting element is distinguished in that a dry glaze is applied on the ceramic element.

By avoiding a slip, it will not be necessary, for example, to provide for the durability of the slip, which is expensive, and the waste-water problem caused by the slip is obviated as well. Since a dry application of the coating is carried out, using sifting, powder, vibration or similar methods, if appropriate, the baking is comparatively fast, which also results in a lower energy consumption of the method according to the present invention. In addition, the expensive post-working of drops that flow off or the like is avoided.

In an advantageous manner, the dry glaze is applied on the ceramic element electrostatically. This ensures that a more even layer thickness is produced compared to previous methods, in particular along the edges and in the grooves (cuts). Thus, the danger of short circuits occurring in a heating element of a sheathed-element glow plug is non-existent, which represents a substantial improvement.

The dry glaze preferably contains 4 to 6% CaO, 4 to 6% BaO, 8 to 12% $Al_2O_3$, 53 to 61% $SiO_2$ as well as 20 to 26% $B_2O_3$, the dry glaze advantageously including 5% CaO, 5% BaO, 10% $Al_2O_3$, 57% $SiO_2$ and 23% $B_2O_3$. By using a dry glaze with an appropriate composition, it is possible to realize an advantageous conductivity and fluidizability of the dry glaze, which substantially improves the electrostatic coating. Furthermore, the use of this lead-free dry glaze reduces the environmental impact.

The composition of an electrostatically applicable dry glaze—in this case, glazing powder—may be wide-ranging, so that the properties of the glazing powder, among them the baking characteristic, the expansion coefficient and the electrical properties of the powder and the baked-in glaze, may easily be adapted to the substrate to be glazed. Particularly suitable glazing powders, such as glass frit, may be coated with insulating substances, such as organo polysiloxanes according to European Patent Application No. EP 0 382 003, so as to increase their specific resistance. Instead of coating a glazing powder with an insulating substance, electrostatically applicable glazing powders may also include a small amount of a carboxylic acid salt according to PCT Patent Publication No. WO 98/54105, to increase the specific resistance and to improve the fluidizability. By using a glazing powder according to PCT Patent Publication No. WO 98/58889, which contains two glass frits having different softening onsets, good quality glazes may be achieved with a high layer thickness. According to PCT Patent Publication No. WO 94/26679 or PCT Patent Publication No. WO 97/08115, the adhesive strength of the glazing powder on the substrate before firing may be enhanced by also using a physically or chemically activable organic adhesive agent, such as a thermoplastic polymer.

In a special further refinement of the present invention, an electrically insulating ceramic element is used. In this way, the coating of the ceramic element of a spark plug, for a spark-ignition engine, for example, is also able to be realized.

In another specific embodiment, an electrically conductive ceramic element is utilized. This substantially simplifies the electrostatic coating and simultaneously allows the coating of a heating pin for a sheathed-element glow plug according to the present invention, for example for a diesel engine. In this context, the substantially more even coating of the edges that is able to be realized compared to previous methods is decisive for the functioning of the sheathed-element glow plug. This was not reliably ensured by the conventional manufacturing methods.

DETAILED DESCRIPTION

Figure 1:
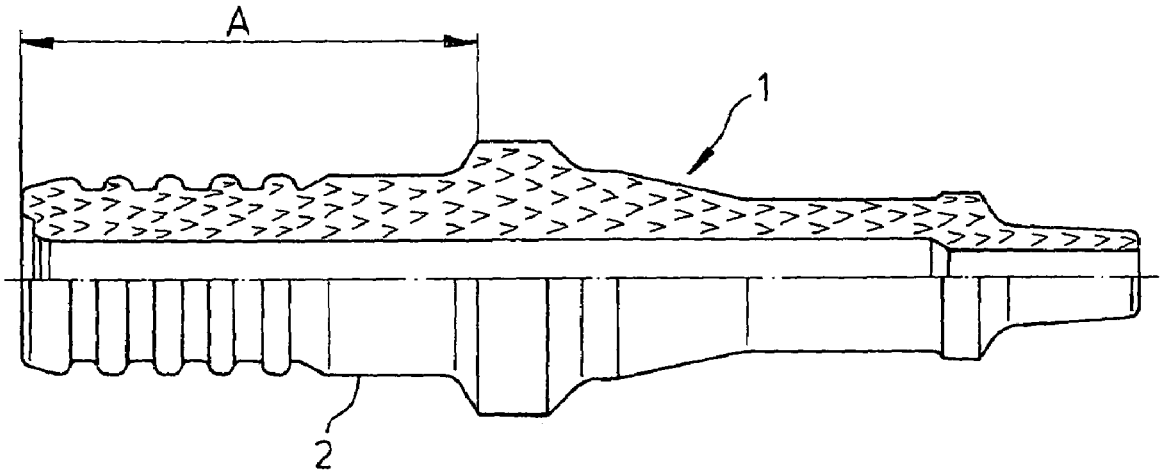
FIG. 1 shows an electrically insulating ceramic element according to the present invention.

FIG. 1 shows an electrically insulating ceramic element 1, which has a glaze 2 in a region A. Both the stability of ceramic element 1 and the repelling of dirt and water are improved by glaze 2. This reduces, in particular, damage during installation or disassembly and also the occurrence of malfunctions during operation.

Figure 2:
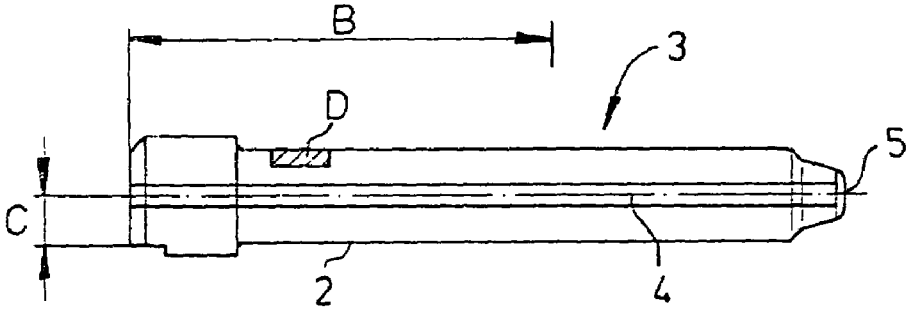
FIG. 2 shows an electrically conductive ceramic element for a sheathed-element glow plug according to the present invention.

FIG. 2 shows an electrically conductive ceramic element 3 for a sheathed-element glow plug, which is coated in a region B with a glaze 2 applied according to the present invention. In this case, glaze 2 is applied both on the surface area and also in the frontal area of ceramic element 3. After ceramic element 3 has been electrostatically coated and glazed, the glaze is removed again in a semicircular region C and a rectangular region D, by filing it off, for example, and a contacting is in each case affixed to both regions C, D in a manner not shown further.

Ceramic element 3 has an insulating layer 4, the positive pole being realized, for example, by way of the contacting of region C during operation of the sheathed-element glow plug, and the negative pole by way of the contacting in region D. With the aid of a current flow realized via the contacting, ceramic tip 5 begins to glow relatively quickly, so that the starting procedure of a diesel engine is advantageously shortened compared to metallic sheathed-element glow plugs.

In the installed state of the sheathed-element glow plug, glaze 2 allows the sheathed-element glow plug to be insulated from the metallic engine housing.

Figure 3:
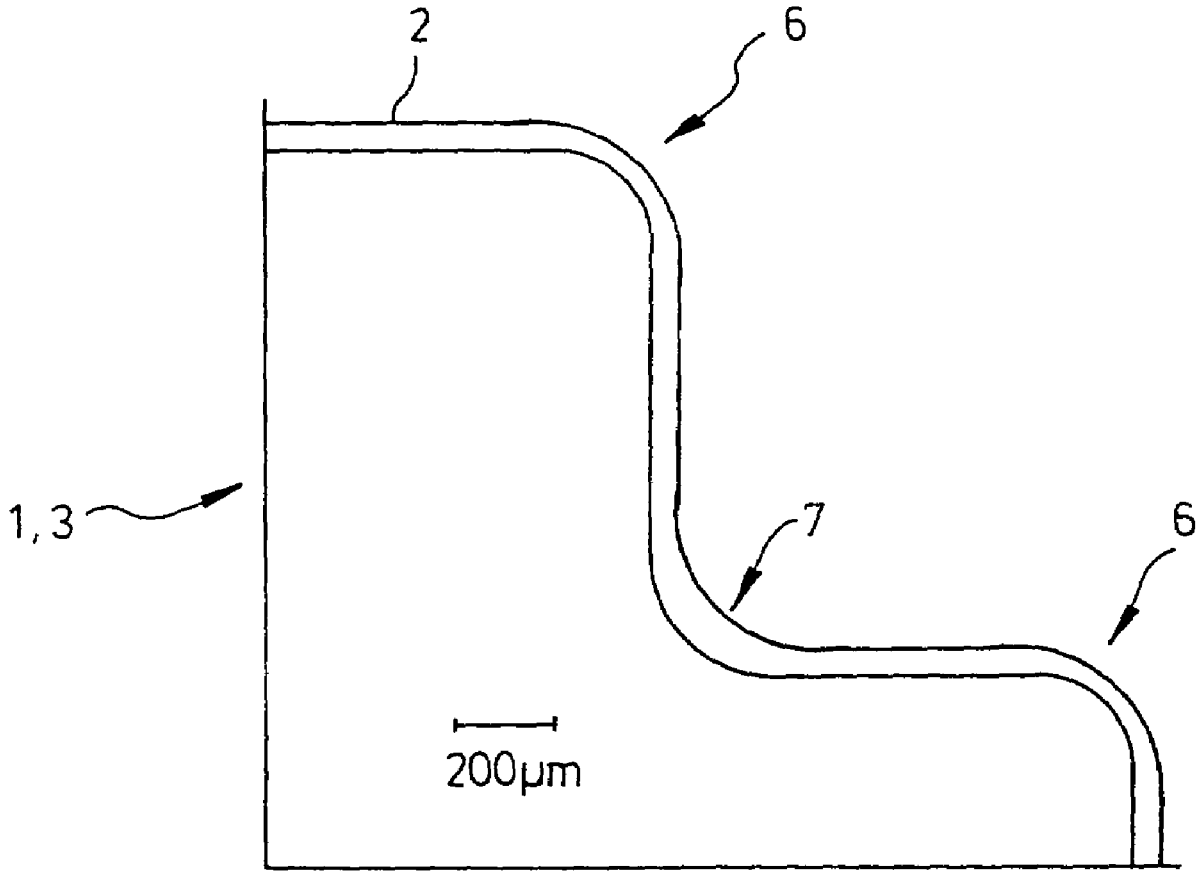
FIG. 3 shows a cut-away portion of a longitudinal groove of a coated ceramic element according to the present invention.

FIG. 3 shows a cut-away portion of a longitudinal groove (cut) of a ceramic element 1, 3. FIG. 3 illustrates that glaze 2 has a relatively even layer thickness both at edges 6 and also in a groove 7. Especially the comparatively thick coating at edges 6 is decisive for the functioning of a sheathed-element glow plug. The relatively thin layer in grooves 7 is also advantageous in this context.

LIST OF REFERENCE NUMERALS

1 ceramic element
2 glaze
3 ceramic element
4 insulating layer
5 tip
6 edge
7 groove
A Region
B Region
C Region
D Region

What is claimed is:

1. A method for manufacturing a starting element for a combustion process in an internal combustion engine having a ceramic element, the method comprising:

applying a dry glaze on the ceramic element;

wherein the dry glaze is electrostatically applied on the ceramic element.

2. The method according to claim 1, wherein the starting element is a sheathed-element glow plug.

3. The method according to claim 1, wherein the dry glaze contains by weight 4 to 6% CaO, 4 to 6% BaO, 8 to 12% $Al_2O_3$, 53 to 61% $SiO_2$ and 20 to 26% $B_2O_3$.

4. The method according to claim 1, wherein the dry glaze contains by weight 5% CaO, 5% BaO, 10% $Al_2O_3$, 57% $SiO_2$ and 23% $B_2O_3$.

5. The method according to claim 1, wherein the ceramic element is an electrically insulating ceramic element.

6. The method according to claim 1, wherein the ceramic element is an electrically conductive ceramic element.

7. A ceramic element system, comprising:

a starting element configured to start a combustion process in an internal combustion engine, the starting element including:

a ceramic element having a dry glaze electrostatically applied on it, wherein the ceramic element substantially consists of electrically conductive ceramics.

8. The ceramic element system according to claim 7, wherein the starting element is a sheathed-element glow plug.

9. The ceramic element system according to claim 7, wherein the dry glaze contains by weight 4 to 6% CaO, 4 to 6% BaO, 8 to 12% $Al_2O_3$, 53 to 61% $SiO_2$ and 20 to 26% $B_2O_3$.

10. The ceramic element system according to claim 7, wherein the dry glaze contains by weight 5% CaO, 5% BaO, 10% $Al_2O_3$, 57% $SiO_2$ and 23% $B_2O_3$.

11. A sheathed-element glow plug comprising:

a ceramic element substantially consisting of electrically conductive ceramics; and a dry glaze electrostatically applied on the ceramic element.

* * * * *